US005309855A

United States Patent [19]

Böttger et al.

[11] Patent Number: 5,309,855

[45] Date of Patent: May 10, 1994

[54] SUBMARINE WEAPON

[75] Inventors: Wolfgang Böttger, Dusseldorf; Uwe Kellermeier, Weyhe; Gerrit Plümecke, Bremen; Rainer Schöffl, Odenthal, all of Fed. Rep. of Germany

[73] Assignee: Dynamit Nobel Aktiengesellschaft, Troisdorf, Fed. Rep. of Germany

[21] Appl. No.: 812,009

[22] Filed: Dec. 23, 1991

[30] Foreign Application Priority Data

Dec. 22, 1990 [DE] Fed. Rep. of Germany ..... 4041457

[51] Int. Cl.[5] ..... F42B 19/00; F42B 19/01

[52] U.S. Cl. ..... 114/20.2; 114/21.3

[58] Field of Search ..... 114/20.1, 21.3, 22, 114/20.2, 337

[56] References Cited

U.S. PATENT DOCUMENTS 3,154,041 10/1964 McKinnon ..... 114/25
3,158,994 12/1964 Hodgson ..... 114/20.1
4,192,246 3/1980 Hodges et al. ..... 114/20.1
4,264,788 4/1981 Keidel et al. ..... 310/327
4,709,665 12/1987 Ewbank et al. ..... 114/20.1
4,942,219 7/1990 Yatsuka et al. ..... 528/272
5,042,162 8/1991 Helms .

OTHER PUBLICATIONS

DE-Zeitschrift "Wehrtechnische Monatshefte", 1961, Heft 6, S. 253-266.

DE-Buch: E. Schmidt, "Thermodynamik", Springer Verlag 1956, S. 305, 306, 314-318.

*Primary Examiner*—J. Woodrow Eldred

*Attorney, Agent, or Firm*—Antonelli, Terry, Stout & Kraus

[57] ABSTRACT

In a submarine weapon, particularly for combating submarines, a rocket engine with continuous rocket thrust is utilized as the submarine drive unit. An actively locating, acoustic target seeking device is provided for target detection and target pursuance, the ranging frequency of which is selected so that the echo level to be expected from its detection range lies above the noise level of the rocket engine.

7 Claims, 1 Drawing Sheet

SUBMARINE WEAPON

BACKGROUND OF THE INVENTION

The invention relates to a submarine weapon, particularly for combating submarines having a rocket engine and an actively locating, acoustic target seeking device.

Submarine weapons for the combating of submarines are known as torpedoes which, upon entering the water, will locate a submarine by means of the acoustic target seeking device and are steered toward the submarine by means of a steering unit evaluating the ranging results (homing). The torpedoes are usually equipped with a relatively low-noise propeller drive unit in order to prevent impairment of the function of the acoustic target seeking device by too high an intrinsic noise level. The propeller in this system is driven by a gas turbine, an internal combustion engine, or an electric motor.

A submarine weapon for antisubmarine use has been known under the term ASROC system, consisting of a torpedo of the MK 46 type, a rocket engine, and a parachute. This system is airborne, i.e. it is fired in each case from a surface vessel or an aircraft. Upon entrance into the water, the torpedo separates from the other parts of the system and is caused to home after target detection.

The propeller-driven torpedoes have the draw-back of mechanically very sophisticated drive mechanisms causing a great deal of expenditure. In case the propeller is driven electrically, a considerable portion of the volume and weight of the torpedo is taken by the batteries. Additionally, such torpedoes are not exempt from servicing over a prolonged period of time; rather, the torpedoes must be operated at regular intervals to ensure their functioning.

A submarine weapon of the type heretofore described has been known (DE 3,100,794 Al) which is transported into the proximity of the target by means of the rocket engine through the air from a mother ship. Upon entrance into the water, the rocket chamber serves as the operating chamber of a hydraulic pulsed engine by means of which the weapon is driven underwater. The hydraulic pulsed engine operates by repeatedly filling the rocket chamber with water which is then ejected at high velocity through a nozzle at the rear of the weapon body by means of a number of gas pressure generators ignited in succession. During the burning of one of the gas generators and the subsequent ejection of water from the rocket chamber in order to accelerate the submarine weapon, a considerable intrinsic noise is produced. However, between the drive impulses, the inherent noise of the hydraulic pulsed drive mechanism is at a minimum so that the acoustic sensors of the target locating device are capable of listening for noises of a submarine in the surroundings of the submarine weapon. The interval operation of hydraulic pulsed motor and acoustic target seeking device, though, represents a compromise that is not close to an optimum; on the one hand, the submarine weapon cannot attain any high traveling velocities and, on the other hand, the efficacy of the acoustic target locating device is limited with regard to its ranging zone.

SUMMARY OF THE INVENTION

The invention is based on the object of providing a submarine weapon of the type discussed hereinabove which exhibits an economical, effective and, above all, service-free submarine drive unit and an acoustic target seeking device having an adequately large detection zone by means of a continuous operation taking place without interruption during the travel of the submarine weapon.

This object has been attained, in a submarine weapon of the type defined in the preamble of claim 1, in accordance with this invention by the features in the characterizing portion of claim 1.

The submarine weapon according to this invention has the advantage that due to the use of the rocket engine with continuous rocket thrust, a highly efficient submarine drive mechanism is made available which can be manufactured in easy and economical fashion and is absolutely free of servicing over long periods of time. An impairment of the continuous operation of the acoustic target seeking device by the high noise level accompanying the rocket engine is avoided by the selection, according to this invention, of the locating or ranging frequency—also called "working frequency'-'—of the acoustic target seeking device.

The shifting of the ranging frequency into a higher frequency range above 80 kHz, connected with this frequency selection, provides the additional advantage that the antenna for transmitter and receiver, with satisfactory focusing, can be made spatially smaller, and it is possible to utilize economical electroacoustic transducers on ceramic basis.

Advantageous embodiments of the submarine weapon with favorable features and further developments of the invention can be seen from the further claims.

If, in accordance with a preferred embodiment of the invention, the outlet nozzle of the rocket engine is made to flare so that the pressure of the exiting propulsion gas at the nozzle end corresponds approximately to ambient pressure, then there will be no generation of a pressure wave in the water which would have a disturbing effect on the target seeking device.

The vibration-damping installation of the rocket engine into the body of the weapon according to another embodiment of the invention permits a further lowering of the noise level radiated into the water. A preferred damping material is polyurethane foam which is injected between the rocket engine and the shell of the weapon body. The attenuating effect of the polyurethane foam is especially strongly pronounced in the frequency range including the operating frequency of the target seeking device.

BRIEF DESCRIPTION OF THE DRAWINGS

The invention will be described, in greater detail hereinafter with reference to an embodiment illustrated in the accompanying drawing wherein.

DETAILED DESCRIPTION OF THE INVENTION

Figure 1:
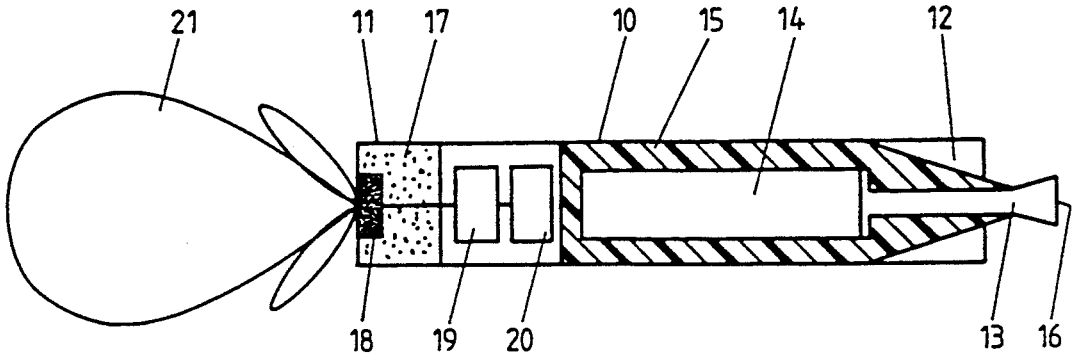
FIG. 1 is a schematically shown longitudinal sectional view of a submarine weapon having a rocket engine and a target seeking device.

The submarine weapon—also called "operating member"—illustrated schematically in FIG. 1 in a longitudinal sectional view comprises a body 10 of the weapon which carries at the front end a warhead 11 and at the rear the control surf aces 12 of a steering unit located in the rear and not shown herein for the sake of clarity. At the rear proper, an exhaust nozzle 13 of a rocket engine 14 can be seen. The rocket engine 14 is provided with a solid propellant charge which operates as an end burner. The rocket engine 14 is surrounded by noise-damping material 15, such as, for example, polyurethane foam, and is fixedly installed in the weapon body 10. The outlet nozzle 13 connected with the rocket engine 14 is widened toward the outlet opening 16 so that the pressure of the exiting propellant gas at the nozzle end corresponds approximately to ambient pressure.

The warhead 11 contains an explosive charge 17 and carries at its front side an antenna or base 18 of an acoustic target seeking device 19. The antenna 18 consists conventionally of a plurality of electroacoustic transducers arranged in a fixed spatial arrangement with respect to one another. The target seeking device 18 operates in an active fashion, i.e. it transmits sonar pulses via the antenna 18 and receives, via the antenna 18, the echo pulses reflected by a target subjected to these sonar pulses. From the direction of incidence and the travel time of the echo pulses, the direction and distance of the located target with respect to the operating member, i.e. the submarine weapon or torpedo are determined. These parameters are fed into a control device 20 generating corresponding steering signals for the steering unit in such a way that the operating member is steered toward the target by means of a suitable steering process (homing). The actively locating, acoustic target seeking device 19 as well as the control device 20 are adequately known so that these devices are not described here in further detail. The ranging function or ranging characteristic of the target seeking device 19, determining the detection or search range of the target seeking device 19, is indicated by reference numeral 21 in FIG. 1. In spite of the embedding of the rocket engine 1 into the noise-damping material 15, attenuating vibrations and noise, the operating member exhibits a very high intrinsic noise level. In order to prevent this high intrinsic noise level from impairing the functional operability of the actively ranging target seeking device 19, the locating frequency of the target seeking device 19 is chosen so that the echo level to be expected from its detection range (locating function 21) lies above the noise level of the rocket engine 14.

Figure 2:
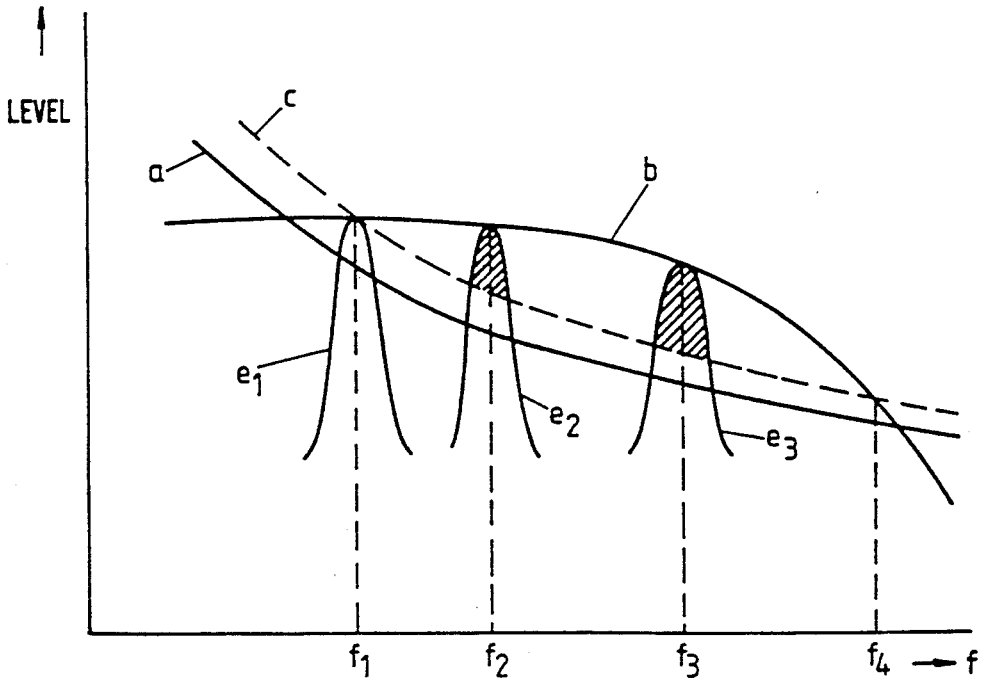
FIG. 2 shows a diagram of various noise level curves in dependence on the frequency of the noise spectrum produced by the rocket engine.

In the diagram of FIG. 2, curve "a" shows the noise level of the rocket engine 14 at the individual frequencies f of its noise spectrum, measured in the water with the rocket engine running. Curve "b" shows the echo level of an echo returning from the target at a predetermined distance, in correspondence with the detection range required in an individual case, at the receiver in dependence on the frequency of the transmission pulse radiated by the target seeking device 19. Curve "c" marks the required effective signal-to-noise ratio of the echo level with respect to the intrinsic noise level for the safe detection of the impinging echoes. By $e_1$, $e_2$ and $e_3$, three examples are indicated for the spectral distribution of the echoes returning from the target upon the transmission of an extremely narrow-band transmission signal of the center frequency $f_1$ or $f_2$ or $f_3$, respectively. With a locating operation using the transmission frequency $f_1$, the level $e_1$ of the echoes received reaches precisely the evaluating threshold (curve "c") predetermined by the sufficient effective signal-to-noise ratio. With this transmission frequency $f_1$, it would theoretically be feasible to effect a target seeking and target pursuing operation of the target seeking device. A far more reliable function of the target seeking device with a secure detection of the target is obtained with transmission frequencies higher than this transmission frequency $f_1$, for example with transmission frequency $f_2$ or $f_3$, since here the echo levels $e_2$ and $e_3$, respectively, far exceed the evaluating threshold (curve "c"). As soon as the optimum ranging frequency has been selected for a specific type of the submarine weapon, this frequency is fixedly set and is no longer altered. Tuning of the resonators, which are piezoceramic, for example, to this ranging frequency takes place in a manner known per se.

This frequency selection is performed as follows: in accordance with the invention, curves "a" and "c" are viewed in conjunction with curve "b" in order to select the optimum echo level.

To make it possible clearly to distinguish the echo from the interfering noise of the motor, the echo level must be a preset minimum amount higher than the natural noise level of the motor. Curve c in FIG. 2 describes this minimum difference. It is reached at operating frequencies above frequency $f_1$ and at frequency $f_4$, the new intersection of curves "b" and "c", the noise level drops below this minimum once more. Hence, the upper Limit for the operating frequency is determined by frequency $f_4$. The useful energy of the signals between frequencies $f_1$ and $f_4$ is indicated by the shaded areas of echo levels $e_2$ and $e_3$ above curve "c".

The echo levels depend on the transmitted intensity, the distance travelled by the acoustic signals—i. e. the range for target location—and the frequency of the acoustic signals. While the transmitted intensity is limited by the transducer design and the size of the power source the detection range is influenced by frequency: higher frequencies result in shorter detection ranges. This can be recognized from the downslope of curve "b" in FIG. 2 at higher frequencies. This curve gives the echo levels for a fixed transmitter intensity and a fixed range to the target over frequency. In order to achieve a long detection range, the frequencies of acoustic seeks in known applications are usually far below the 80 kHz quoted in the description. In this frequency range (frequencies up to fl in FIG. 2), however, the noise level of a continuously operating rocket motor is very close to or above the level of the returning echoes as curve "a" in FIG. 2 shows. The shape of curve a will be similar for all underwater rocket motors while the level of the noise depends on the thrust on the motor design. Since in certain cases, where the target location is roughly known, a long defection range is not required it is therefore advantageous to adapt the operating frequency of the acoustic device in the vehicle to the noise spectrum of the rocket motor. Comparison of curves "a" and "b" in FIG. 2 shows, that a maximum overshoot of echo level over motor noise is achieved at frequency $f_3$.

In order to clearly separate the echoes from the noise a minimum offset of the echo levels from the noise level is required. This minimum offset is given by curve "c" in FIG. 2.

What is claimed is:

1. A submarine weapon for combating submarines which comprises a rocket engine and an actively locating, acoustic target seeking device said rocket engine providing a continuous rocket thrust jet and comprising a drive unit for said weapon, and said target seeking device having a ranging frequency that is selected so that an echo level to be expected from a detection zone of the acoustic target seeking device lies above a noise level of the rocket engine.

2. A submarine weapon according to claim 1, wherein a transmission frequency is specified as a ranging frequency (f) of the target-seeking device such that, at this frequency, the difference in level between an echo (e) anticipated at a given detecting range and the noise level (a) of the rocket engine is at a maximum.

3. A submarine weapon according to claim 1 or claim 2, wherein an exhaust nozzle of the rocket engine is made to flare toward an outlet opening in such a way that ambient pressure is attained in the thrust jet in the region of the outlet opening.

4. A submarine weapon according to claim 1, further comprising a weapon body, said acoustic target seeking device being located at a front end of said body and the rocket engine being located at a rear end of said body, the rocket engine being installed in the body of the weapon in an arrangement for damping noise and vibration generated by the rocket engine, said arrangement comprising a noise damping material which surrounds all of the engine except for an exhaust nozzle extending outwardly from said body.

5. A submarine weapon according to claim 2, further comprising a weapon body, said acoustic target seeking device being located at a front end of said body and the rocket engine being located at a rear end of said body, the rocket engine being installed in the body of the weapon in an arrangement for damping noise vibration generated by the rocket engine, said arrangement comprising a noise damping material which surrounds all of the engine except for an exhaust nozzle extending outwardly from said body.

6. A submarine according to claim 4, wherein said noise damping material comprises a polyurethane foam.

7. A submarine weapon according to claim 5, wherein said noise damping material comprises a polyurethane foam.

* * * * *